United States Patent [19]

Endo et al.

[11] 4,089,183

[45] May 16, 1978

[54] CONSOLIDATION CONSTRUCTION FOR IMPROVING SOFT, UNSTABLE FOUNDATION

[75] Inventors: Masaaki Endo, Omiya; Mitsuo Miura; Yoshinori Kukino, both of Tokyo, all of Japan

[73] Assignees: Kabushiki Kaisha Takenaka Komuten, Osaka; Kabushiki Kaisha Takenaka Doboku, Tokyo, both of Japan

[21] Appl. No.: 726,204

[22] Filed: Sep. 24, 1976

[51] Int. Cl.[2] ..... E02D 3/12

[52] U.S. Cl. ..... 61/50; 61/35; 61/36 R; 61/49

[58] Field of Search ..... 61/50, 49, 35, 36 R, 61/36 B, 36 C

[56] References Cited

U.S. PATENT DOCUMENTS

| | | | |
|---|---|---|---|
| 3,274,783 | 9/1966 | Handy | 61/35 |
| 3,800,544 | 4/1974 | Nakanishi | 61/35 |

FOREIGN PATENT DOCUMENTS

| | | | |
|---|---|---|---|
| 51,592 | 11/1966 | Germany | 61/50 |

*Primary Examiner*—Jacob Shapiro

*Attorney, Agent, or Firm*—Edwin E. Greigg

[57] ABSTRACT

Consolidation construction for soft, unstable foundation for improving the bearing strength in order to fill earth thereon as in land reclaiming or to build structural construction thereon including dikes and roads. Examples of such unstable foundation requiring consolidation are: sea bottom with soft unsolid sedimentation heap as often referred to recently in Japan as HEDORO, muddy swamp land, layer of slimy industrial waste sludge of much water content and the like. Consolidation is effected on the spot by admixing hardening agent, such for instance as cement, with the slimy mud heap constituting the soft, unstable foundation. The construction is featured by a large number of consolidated walls juxtaposed one after another, each extending along the direction coinciding with the direction in which the maximum sliding, shearing rupture stress appears under the gravity load of the superstructure, namely the fill-soil or the edifice, built on the soft, unstable foundation improved by this consolidation construction; and ensures dynamically very stable consolidation effect, with quite large bearing strengths both for the vertical gravity load from the above and for the sliding, shearing rupture stress.

7 Claims, 7 Drawing Figures

CONSOLIDATION CONSTRUCTION FOR IMPROVING SOFT, UNSTABLE FOUNDATION

BACKGROUND OF THE INVENTION

In attempting to fill earth as in land reclaiming or to build structural construction including dikes and roads, on soft, unstable foundation as formed by layer of slimy mud such as industrial waste sludge or unsolid sedimentation heap often referred to recently in Japan as HEDORO; bearing strength of such foundation is often quite insufficient to sustain the load of such superstructure. In fact, the uniaxial compression strength of the soft layer such as the sea-bottom HEDORO is usually less than 1 $Kg/cm^2$. There is a fear, therefore, of causing sliding rupture or sinking down of such soft foundation if the earth is filled as in land reclaiming or a structural construction is built thereon without improving the strength or solidity of the foundation.

It is conventional, in such attempting to fill earth as in land reclaiming or to build structural construction, thus to generally practice civil or architectural engineering work, on the site of the soft, unstable foundation as mentioned above, either to drive down piles through the soft foundation down to hard, stable substratum or to improve the foundation itself to have sufficient bearing strength. Of these two processes, the former has the drawbacks in that the pile driving causes difficulty when the soft, unstable foundation is very deep and that the process is economically unfavorable when very wide area is to be covered; and thus the latter has wider scope of applicability and is actually used more generally.

Practically, the conventional strengthening constructions for improving the soft, unstable foundation are as follows:

(A) Replacement strengthening construction by replacing the slimy mud material of the soft, unstable foundation with material of good sustaining strength in civil engineering, such for instance as sand.

(B) Compression strengthening construction by compressing the soft, unstable foundation under proper load put thereon.

(C) Sand-draining compression strengthening construction by positively forming draining canals within the soft, unstable foundation as will thus enhance the compression.

(D) Strengthening construction by providing piles of quicklime or the like within the soft, unstable foundation, which pile material is to absorb water, generate heat and cause compression of the foundation. And (E) Strengthening construction by admixing hardening agent, as cement and other chemical, in the soft, unstable foundation which is thus consolidated as an entirety.

Reviewing these constructions, the one mentioned under (A) has the drawbacks in that much labor, time and cost are required for excavating out the soft, unstable foundation material and substituting the sand therefor and also that the disposal of the excavated slimy mud is a troublesome problem; while those mentioned under (B), (C) and (D) all require quite extensive preparatory works, are low in labor efficiency, are not applicable in the first place when the foundation is under water, and can not guarantee sufficient actual improvement of the bearing strength of the foundation.

In comparison with those construtions (A), (B), (C) and (D), the construction (E) is most simple in its actual working operation, since it requires only to apply the hardening agent into the soft, unstable foundation and to admixing same in situ. It may also here be expected to seal up harmful or noxious material within the consolidated blick, and this may thus be fitted particularly as the construction for strengthening the sea-bottom heap HEDORO. There remain, however, still considerable difficulties as to the labor efficiency and overall economy in actually using this constrution in the conventional manner of hardening the whole entirety of the soft, unstable foundation; because of the great amount of the expensive hardening agent as required in such case and of the accordingly great volume to be covered by the admixing operation. Moreover, it is very difficult to effect uniform admixing throughout the whole entirety, and it resulted in a fear of causing localized sinking down when something is built on the foundation improved in this manner.

SUMMARY OF THE INVENTION

The present invention is to offer consolidation construction for improving soft, unstable foundation, which will eliminate the shortcomings and drawbacks of the conventional constructions by reducing the required amount of the hardening agent to the minimum, namely by minimizing the volume of the foundation to be actually consolidated by the hardening agent, yet obtaining dynamically quite stable consolidation construction as may thus be realized very economically and efficiently.

Consolidation construction for improving soft, unstable foundation according to the present invention comprises a large number of consolidated walls juxtaposed one after another, each extending along the direction coinciding with the direction in which the maximum sliding, shearing rupture stress appears under the gravity load of the superstructure built on the soft, unstable foundation improved by this consolidation construction, thereby ensuring sufficiently improved bearing strengths both for the vertical gravity load and for the sliding, shearing rupture stress.

This features, therefore, in improving as required the bearing strength of the soft, unstable foundation by admixing in situ the slimy mud material of the foundation with the hardening agent, not to effect hardening of whole entirety of the soft, unstable foundation layer but to effect actual hardening only of some localized portions within the foundation subjected under the load of the superstructure, and in fact in such consolidated form as is best suited in each of said localized portions for effectively enhancing the bearing strength against sliding, shearing rupture stress, which is one of the most important factors of the bearing strengths in general of the foundation. In this way, actual range of hardening treatment and actual volume so treated are very small even in improving the soft, unstable foundation spreading over a wide area, and the volume of the hardening agent needed here is accordingly saved to quite considerable extent.

As above, here is realized the consolidation construction for improving the soft, unstable foundation, which may be obtained quite efficiently and economically because of the reduction of the range and volume of the foundation actually hardened and which is yet dynamically very stable with quite highly improved strengths both for the vertical gravity load from above and for the sliding, shearing rupture stress.

According to a feature of the present invention, the consolidated walls may each be formed in the soft, unstable foundation in continuous strip shape extending along the direction coinciding with the direction in which the maximum sliding, shearing rupture stress appears. With this construction, bearing strength for the sliding, shearing rupture stress may be retained sufficient enough even if the consolidated walls are each made thin, facilitating the operation of admixing the hardening agent from above the soft, unstable foundation.

According to a preferred embodiment of the present invention, a large number of said consolidated walls formed in the soft, unstable foundation each in a continuous strip shape may laterally be interconnected one after another with lateral interconnecting consolidated walls, thus resulting in providing an entirety of netted skeleton consolidation construction within the foundation layer. With this construction, rigidity of the whole entirety of the foundation improved hereby is enhanced substantially. Bearing strength for the shearing stress is naturally expected quite high, and furthermore, this construction is characterized by the ideal uniform distribution of the load of the superstructure all over the improved foundation area, as will serve for securely eliminating any local sinking down and heaving of the foundation. Still more, this construction has also the advantage of sealing up harmful or noxious material within the foundation, since the unconsolidated soft, unstable foundaton layer is thereby surrounded up.

To repeat, the object of the present invention is thus to offer consolidation construction for improving soft, unstable foundation such for instance as HEDORO heap-layer, muddy swamp land, layer of slimy industrial waste sludge of much water content and the like, to dynamically very stable consolidated foundation, as may be realized quite economically and efficiently.

Another object of the present invention is to offer consolidation construction for improving foundation, which is excellent particularly in the bearing strength for sliding, shearing rupture stress and which may be realized by quite convenient operation.

Yet another object of the present invention is to offer consolidation construction for improving foundation, which is characterized by the ideal uniform distribution of the load of the superstructure all over the improved foundation area and by the capacity of sealing up harmful or noxious material as may be present in the foundation.

For a better understanding of this invention and still further objects and advantages, reference will be made to the following description and accompanying drawings and to the appended claims in which the new and novel features of this invention are set forth.

DESCRIPTION OF THE PREFERRED EMBODIMENTS

How the present invention is performed is now described with reference to the accompanying drawings which show in non-limitative manner some preferred embodiments of the present invention.

Figure 1:
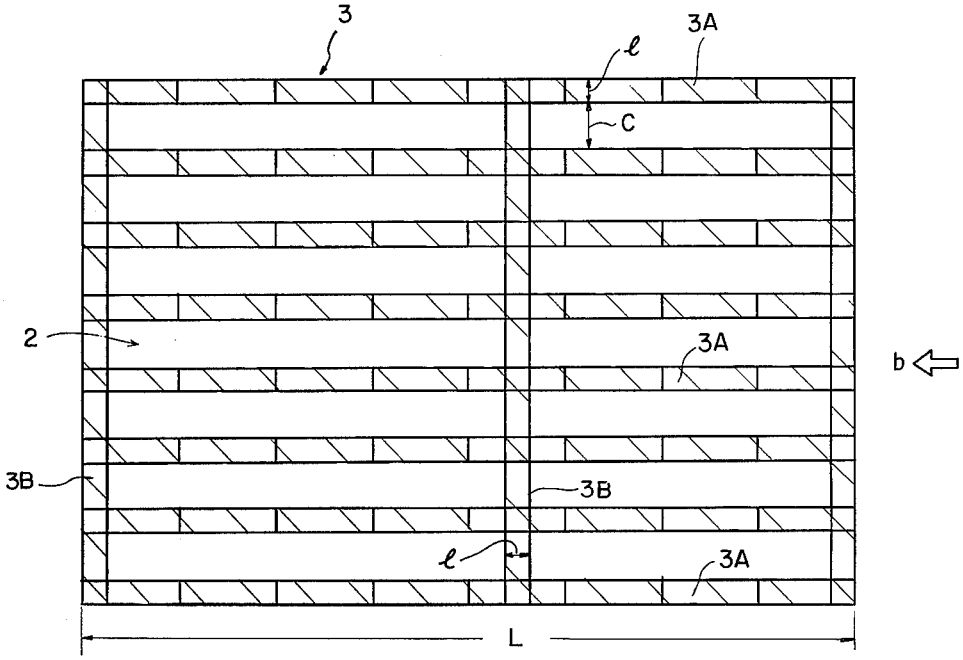
FIG. 1 is a horizontal sectional view of the consolidation construction effected for improving soft, unstable foundation deposited on a hard, stable substratum according to the present invention.
Figure 2:
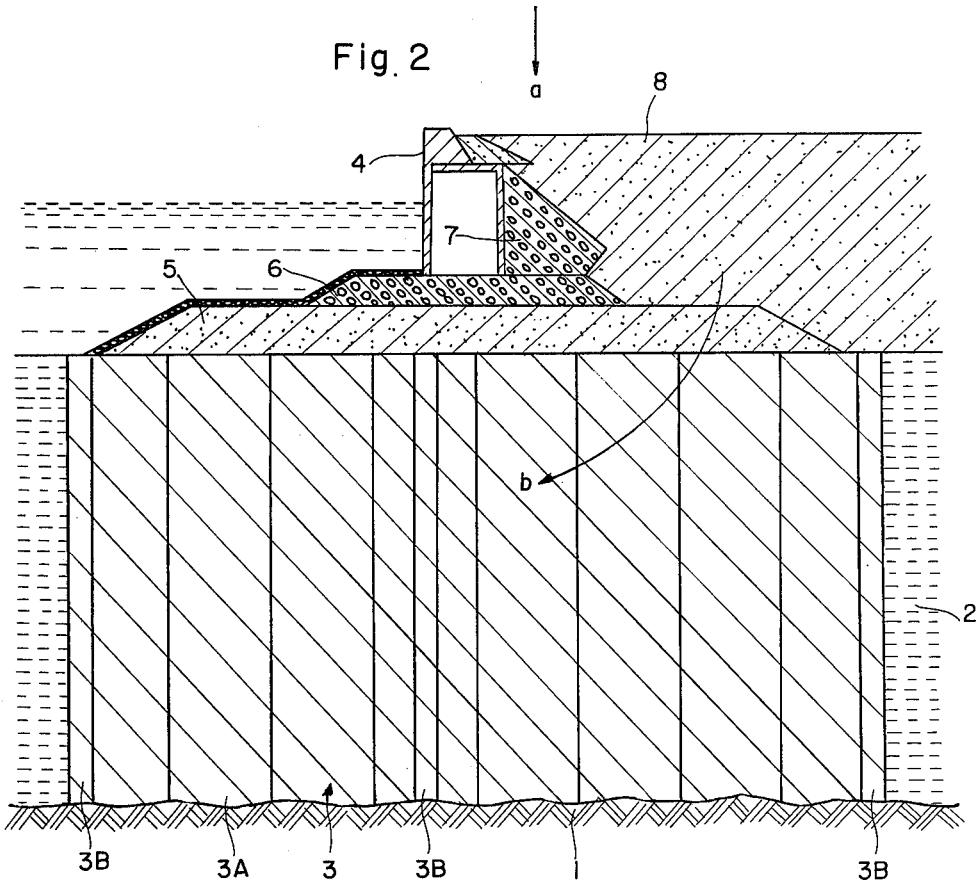
FIG. 2 is a vertical sectional view of an example of land reclaiming realized on the consolidation construction effected for improving the foundation according to the present invention.
Figure 3:
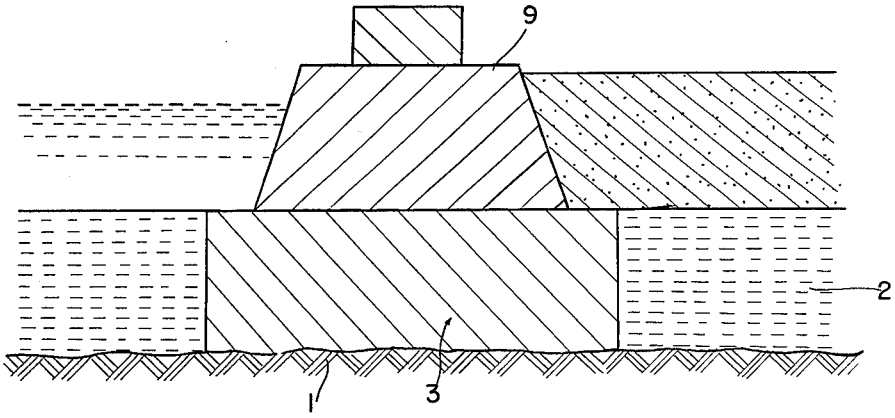
FIG. 3 is a vertical sectional view of an example of building work realized on the consolidation construction effected for improving the foundation according to the present invention.

FIGS. 2 and 3 both show hard, stable sea-bottom substratum 1 and soft, unstable heap or layer 2 deposited thereon such for instance as HEDORO in which improved foundation construction 3 is formed by effecting consolidation through the entire soft layer height down to the substratum 1, in shape of walls of the plan view section as shown in FIG. 1.

The consolidated construction 3 has proper dimension of wall thickness *l* and length L as shown in FIG. 1, to provide dynamically stable foundation under gravity load, acting in the vertical direction shown by arrow *a* in FIG. 2, of a caisson pier 4, foundation sand fill 5, foundation riprap 6, backing riprap 7 and land reclaiming soil 8, as built up on the improved foundation construction 3 in the case shown in FIG. 2, and, as seen in FIG. 1, has the form of continuous consolidated walls 3A extending along the direction of arrow *b* in FIG. 2, in which the maximum sliding, shearing rupture stress appears in the foundation layer 2 under the gravity load of the soil mass 8, disposed in a large number juxtaposed one after another in parallelism or in substantial parallelism with one another at proper intervals *c* as seen in FIG. 1, with consolidated connection walls 3B disposed normal to or substantially normal to the walls 3A, interconnecting the said walls 3A together.

With consolidation construction 3 of the continuous skeleton structure as described above, the soft, unstable foundation 2 is improved to have sufficient bearing strength both for the vertical gravity load and for the sliding, shearing rupture stress.

In the case as shown in FIG. 3, where a heavy article 9 is built on the consolidated foundation 3 of the skeleton structure with continuous walls, the effect of improving the foundation is obtained just similarly as in the foregoing case described with respect to said land reclaiming soil 8.

Figure 5:
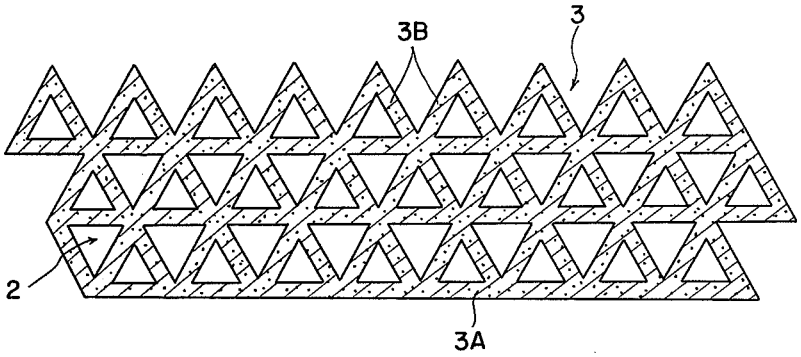
FIGS. 4 and 5 are respective horizontal sectional views of two different modifications of that shown in FIG. 1.
Figure 4:
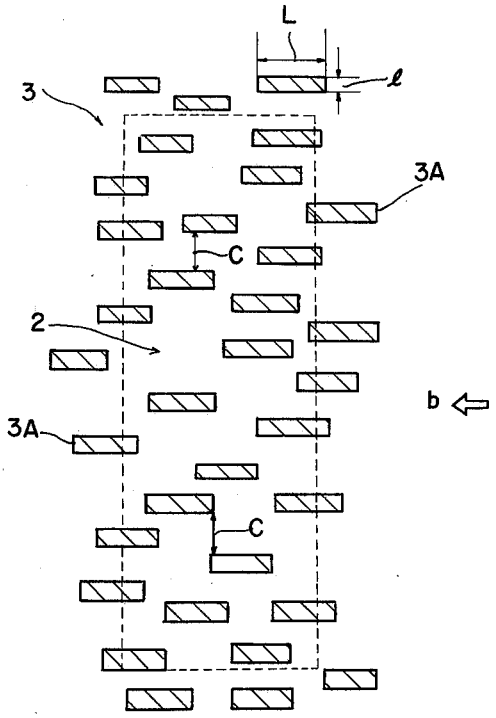

FIGS. 4 and 5 show modified forms, respectively, of the consolidation construction to be effected in the soft, unstable foundation layer 2. The specific structure shown in FIG. 4 is featured in that the consolidated walls 3A, each with horizontal sectional form of oblong generally rectangular shape with the longitudinal axis of the oblong sectional shape coinciding with the direction in which the maximum sliding, shearing rupture stress appears in the foundation 2, has the length in that longitudinal direction to be only a small fraction of the overall length in that direction of the entire whole of the consolidated foundation area which thus corresponds to the length L shown in FIG. 1, and that a large number of such separate or individual walls 3A are provided all over the entire foundation improving area in random scattering, keeping uniformity or consistency only of the oblong longitudinal axes of all these individual walls 3A. On the other hand, the specific structure shown in FIG. 5 is featured in that the aforementioned consolidated connection walls 3B are provided in slant disposition of the angle substantially equal to 60° both to the right and to the left with respect to the continuous consolidated walls 3A, thus resulting in the horizontal sectional form of continuous regular triangles of the skeleton structure as seen in FIG. 5. This structure is characterized by the excellent bearing strength for the shearing stress and also by the capacity of sealing up harmful or noxious material as might be present in the soft, unstable foundation layer 2.

Figure 6:
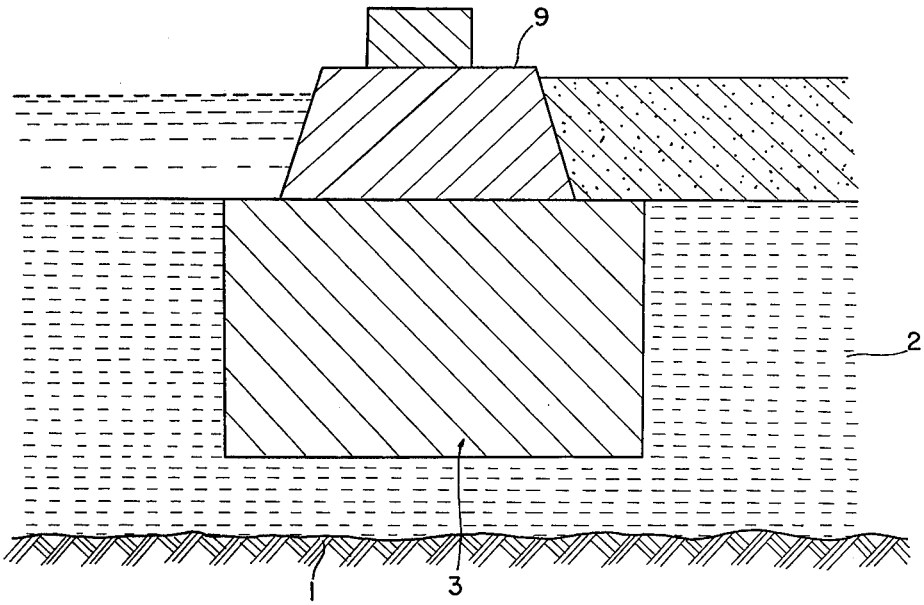
FIG. 6 is a vertical sectional view of a modification of that shown in FIG. 3.

Shown in FIG. 6 is a modified embodiment of the present invention as might be applicable in case where the soft, unstable foundation 2 is in heap of quite deep layer. As illustrated, consolidated construction 3, consisting of both of the two kinds of walls 3A and 3B or only of the walls 3A, is here formed in the soft, unstable layer 2 not through the entire height or depth thereof down to the substratum 1 but in fact only to a suitable depth intermediary of the entire height of the layer. The consolidated construction 3 may of course have any suitable horizontal sectional form as desired, as shown either in FIG. 1, 4 or 5. In any event, the degree of improving the bearing strength of the foundation for the vertical load is in this case less than that as would be attained in case of thorough consolidation down to the bottom as shown in FIG. 2 or 3, and so the consolidated walls, either 3A and 3B or only 3A, should in this case have larger dimension, with respect to their thickness $l$ and/or the vertical depth, than in the case of said thorough consolidation down to the bottom.

How much fraction of the area of the foundation 2 to be improved should actually be consolidated, thus the ratio of the total horizontal sectional area of the actually consolidated construction 3 to the overall area of the foundation 2 to be improved, namely the total rectangular horizontal sectional area including the said entire consolidated construction 3 as well as the unconsolidated foundation lots encased therewithin in the case illustrated in FIG. 1, or approximately the rectangular area surrounded by broken lines in the case illustrated in FIG. 4, should be selected from the predetermined values for obtaining sufficient bearing strength for the load of the superstructure as the land reclaiming soil or some article built on the foundation as described above.

How to realize the consolidated construction 3 in the soft, unstable foundation 2 by hardening same according to the present invention is now described.

Figure 7:
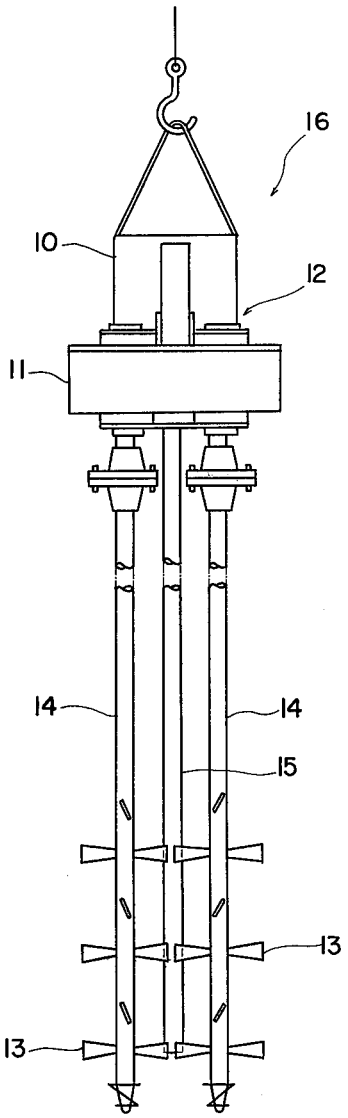
FIG. 7 is a side view of an admixing agitator assembly for use in effecting the consolidation construction according to the present invention.

FIG. 7 shows an admixing agitator assembly 16 for use in effecting the consolidation construction 3, which has a driving unit 12 comprising an oil hydraulic motor 10 and reduction gear assembly 11, a plurality of admixing agitation shafts 14 operatively connected to the driving unit 12 and provided with agitator blades 13 on the lower portion thereof, and an injection pipe 15 suspended to extend down in parellelism with the shafts 14. This assembly 16 is suspended by any suitable suspension means such for instance as a crane (not illustrated), and is lowered to have the admixing agitation shafts 14, while being rotated, inserted into the soft, unstable foundation 2, simultaneously with supplying the hardening agent as pumped down through the injection pipe 15 to be injected from the bottom opening thereof into the ambient soft, unstable foundation 2. This agitation process of admixing hardening agent by the rotating agitator blades 13 is effected until the completion of the treatment as desired, namely down to the hard, stable substratum 1 or to the predetermined suitable depth, as the case may be. Thereupon, this assembly 16 is moved in a lateral direction and the agitation process is repeated in such place in a manner just similar to the foregoing description, thus to result in forming up a consolidated wall 3A in a continuous band or strip shape. Alternatively, the assembly 16 may once completely be raised up clear of the upper surface of the foundation 2 and laterally moved for effecting the similar agitation process in such place somewhat apart from the preceding agitation process site, thus to result in forming up individual or separate consolidated walls 3A of oblong or generally rectangular sectional form. In any way, a predetermined value of fraction of the area of the soft, unstable foundation 2 is treated to form the consolidated wall structure foundation 3.

In such consolidation treatment for improving the foundation according to the present invention by introducing the hardening agent into the soft, unstable foundation followed by admixing and agitation with the assembly 16 as described above, increase in volume by the introduction of the hardening agent will cause the agitated, fluidized admixture to overflow, which will thus spread over the upper surface of the area of the consolidated wall structure foundation 3 and the consolidated wall structure foundation 3 and the unconsolidated soft, unstable foundation 2 surrounded thereby, and will be consolidated there thus in a form of a slab (not illustrated) to cover the upper surface of this area.

Such slab to extend on the upper surface of the consolidated foundation 3 interconnects the consolidated walls 3A formed in the shape either of continuous bands or strips or of separate, individual oblong units as described above. This slab will thus serve to provide an ideal consolidation construction which will distribute the load of some article or land reclaiming soil as built on this slab uniformly all over the consolidated foundation 3. It is further noted, in the case of thorough consolidation down to the hard substratum 1 as shown in FIG. 2 or 3 and with the closed skeleton consolidated wall structure as shown in FIG. 1 or 5, that the harmful or noxious material as might be present in the soft, unstable foundation layer 2 is confined and sealed up by the skeleton structure and such slab.

The assembly 16 illustrated in FIG. 7 and described as above is certainly preferable in effecting the consolidation construction according to the present invention, but it should be noted that this invention may be performed with apparatus of different construction than that.

What we claim is:

1. Consolidation construction for improving soft, unstable foundation, formed by admixing hardening agent therein; comprising a large number of consolidated walls juxtaposed one after another, each extending along the direction coinciding with the direction in which the maximum sliding, shearing rupture stress appears under the gravity load of the superstructure built on the soft, unstable foundation improved by this consolidation construction, said walls being connected together by a mixture of said hardening agent and the said soft unstable foundation which covers said consolidation and a portion of said foundation, thereby ensuring sufficiently improved bearing strengths both for the vertical gravity load and for the sliding, shearing rupture stress.

2. The consolidation construction for improving soft, unstable foundation, as recited in claim 1, in which the consolidated walls are each formed in continuous strip shape extending along the direction coinciding with the direction in which the maximum sliding, shearing rupture stress appears, throughout the entire area of the foundation to be improved.

3. The consolidation construction for improving soft, unstable foundation, as recited in claim 2, in which a large number of said consolidated walls formed in the soft, unstable foundation each in a continuous strip shape are laterally interconnected one after another with lateral interconnecting consolidated walls, thus resulting in an entirety of netted skeleton consolidation construction within the foundation layer.

4. The consolidation construction for improving soft, unstable foundation, as recited in claim 3, in which the lateral interconnecting consolidated walls are disposed to extend normal to or substantially normal to the continuous strip shape walls interconnected thereby.

5. The consolidation construction for improving soft, unstable foundation, as recited in claim 1, in which each of the consolidated walls has the length of only a small fraction of entire whole of the consolidated foundation area even in said direction in which the maximum sliding, shearing rupture stress appears.

6. The consolidation construction for improving soft, unstable foundation, as recited in claim 1 wherein said consolidation and a portion of said soft unstable foundation is covered by the admixing of said hardening agent and a portion of the soft, unstable foundation.

7. A method of forming a consolidation construction for improving soft, unstable foundation comprising the steps of;

admixing a hardening agent into said soft unstable foundation by an admixing agitator assembly which concurrently mixes a hardening agent with said soft unstable foundation as it enters said foundation, moving said agitator assembly in various directions to form a large number of consolidated walls juxtaposed one another each extending along the direction coinciding with the direction in which the maximum sliding sharing rupture stress appears under gravity load, and permitting the overflow of the displaced mixture of hardening agent and unstable foundation to flow over said walls and the unconsolidated soft unstable foundation surrounded thereby to connect said walls to said each other and to said unstable foundation.

* * * * *